US008174354B2

(12) United States Patent
Cohen et al.

(10) Patent No.: US 8,174,354 B2
(45) Date of Patent: May 8, 2012

(54) METHOD AND APPARATUS FOR CONTROL OF FAILED THERMISTOR DEVICES

(75) Inventors: Jonathan F. Cohen, Sharon, MA (US); Gabriel Porto, Campinas - SP (BR); Simon C. Kwok, Attleboro, MA (US); Christian V. Pellon, Norton, MA (US)

(73) Assignee: Sensata Technologies Massachusetts, Inc., Attleboro, MA (US)

( * ) Notice: Subject to any disclaimer, the term of this patent is extended or adjusted under 35 U.S.C. 154(b) by 112 days.

(21) Appl. No.: 12/842,077

(22) Filed: Jul. 23, 2010

(65) Prior Publication Data

US 2012/0019348 A1 Jan. 26, 2012

(51) Int. Cl.
*H01C 7/10* (2006.01)
*H01C 1/024* (2006.01)

(52) U.S. Cl. ..... 338/22 R; 338/232; 338/234; 361/106

(58) Field of Classification Search ..... 338/22 R, 338/316, 318, 232, 234, 277; 361/103, 106, 361/27

See application file for complete search history.

(56) References Cited

U.S. PATENT DOCUMENTS

| | | | | |
|---|---|---|---|---|
| 4,635,026 | A * | 1/1987 | Takeuchi | 338/22 SD |
| 6,025,771 | A * | 2/2000 | Kobayashi et al. | 338/22 R |
| 6,169,472 | B1 * | 1/2001 | Kahr | 338/22 R |
| 6,172,593 | B1 | 1/2001 | Mochida et al. | |
| 6,222,715 | B1 * | 4/2001 | Gruhn | 361/103 |
| 6,407,659 | B2 * | 6/2002 | Mochida et al. | 338/22 R |
| 6,489,880 | B2 * | 12/2002 | Miyazaki et al. | 338/22 R |
| 2006/0101841 | A1 * | 5/2006 | Park | 62/298 |

* cited by examiner

*Primary Examiner* — Kyung Lee

(57) ABSTRACT

A thermistor device includes include supports, contacts and offset posts configured to assist the fracturing of failed thermistor "pills" and to distribute the fragments of the fractured pills into compartment away from electrically conductive contacts in order to minimize arcing and overheating.

20 Claims, 6 Drawing Sheets

METHOD AND APPARATUS FOR CONTROL OF FAILED THERMISTOR DEVICES

FIELD OF THE INVENTION

This invention relates generally to motor starting devices and more particularly to positive temperature coefficient (PTC) thermistor devices with improved failure control.

BACKGROUND OF THE INVENTION

Most small compressors for refrigeration applications require a PTC thermistor in line with the compressor start/auxiliary motor winding in order to provide a phase shift between the start/auxiliary motor winding and the main motor winding as well as a means for reducing the start/auxiliary winding current flow as the compressor motor reaches its operating rotational speed. It is possible for the thermistor (commonly referred to as a pill) to enter a state called "thermal runaway," a failure mode during which the thermistor resistance significantly exceeds its typical steady-state (self-regulated) resistance and passes its maximum resistance ($R_{MAX}$) value, after which its resistance decreases and the thermistor heats up at an uncontrolled rate due to the increasing resultant current. One possible thermistor failure mode is fracture, which occurs due to thermal stress.

U.S. Pat. No. 6,172,593, assigned to Murata Manufacturing Co., Ltd., describes a prior art device with spring contacts and non-conductive support posts which maintain contact with the thermistor throughout the normal usable life of the thermistor. Because thermistors used for starting refrigerator compressors typically self-regulate at 160° C.-170° C. during the switched (high-resistance) state, materials in intimate contact with the thermistor electrodes have to have a higher relative temperature index (RTI) which are more expensive. In addition, this embodiment places portions of the thermistor in tension and compression on opposing sides of the pill with those forces reversed in direction near the other end of the thermistor. Unfortunately, under some circumstances if the pill doesn't crack in a manner in which current flow is stopped, fractured portions of the pill (also referred to as rubble) remain in electrical contact with internal terminals which can cause arcing and overheating.

In refrigerator applications there is a need for a more reliable, lower cost design which minimizes electrical arcing, current flow and subsequent overheating upon failure of the pill. Conventional thermistor devices do not always fail in a manner which eliminates excessive overheating and electrical arcing upon failure of the thermistor.

SUMMARY

Conventional thermistor devices do not sufficiently eliminate overheating and arcing problems upon failure of internal components because some of the rubble remains wedged between conductive components.

In one embodiment of the present invention, an electronic device includes an electronic element having opposite sides with first and second electrodes located on the opposite sides of the electronic element, the electronic element having sidewall portions connecting the opposite sides, the surface of the sidewall portions defining an outer periphery of the electronic element; a first elastic support including a first contact section in contact with the first electrode; and a second elastic support including a second contact section in contact with the first electrode at a different position from the first contact section. The device further includes a third support disposed closer to the center of the electronic element than the first contact section and the second contact section, and including a third contact section in contact with the second electrode; and a pair of offset posts disposed on the same side of the electronic element as the third support and each having an end with a tip, and each tip end is closer to an axis, through the centroid of the electronic element and approximately perpendicular to the electronic element, than the first and second contact sections. Such a design advantageously provides better positioned dynamic forces and fulcrum positions to minimize undesired electrical contact after failure.

In a certain embodiment, the first and second elastic supports and corresponding first and second contact sections apply a first and second force, respectively, on the electronic element which is opposed by a third force applied by the third support and third contact section, and the third force individually is greater than either the first force or the second force. This distribution of forces improves the distribution of rubble under failure conditions.

Other embodiments provide a resilient third support, offset posts having slanted cut-away sections or rounded sections, and offset posts spaced apart from the electronic element. Such features can provide a better and more effective distribution of conductive rubble away from electrical contacts thus minimizing arcing and overheating.

In another embodiment, the first and second elastic supports each comprise a cantilever spring. By using cantilever springs additional force can be applied to distribute fragments of a fractured pill further from the electrical contact sections. In yet another aspect of the invention, the third support includes a fusible link and at least one withdrawal spring adapted to remove the third contact section from electrical contact with the second electrode in response to electronic element failure.

Another aspect of the present invention is a method for directing fractured portions of a fractured electronic element such that electrical contact to the electronic element is removed and electrical arcing among fractured portions and contact sections is minimized which includes the steps of providing a housing and a pair of first and second spring contacts disposed in the housing on one side of the electronic element, providing in the housing a pair of offset posts on an opposite side of the electronic element and a third contact disposed therebetween and elastically supporting the electronic element before fracture, with first, second and third spring contacts. Upon fracture of the electronic element, the technique further includes forcing contact of the electronic element with the pair of offset posts and distributing the fractured portions away from the third contact. The embodiments disclosed herein, may be employed in devices such as those manufactured by Sensata Technologies, Inc. of Attleboro, Mass., U.S.A.

BRIEF DESCRIPTION OF THE DRAWINGS

The foregoing will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Embodiments of the invention disclosed herein provide for improved PTC thermistor devices to minimize arcing and overheating upon component failure. Embodiments include supports, contacts and offset posts configured to assist the fracturing of failed thermistor "pills" and to distribute the fragments of the fractured pills into compartment away from electrically conductive contacts in order to minimize arcing and overheating.

Figure 1:
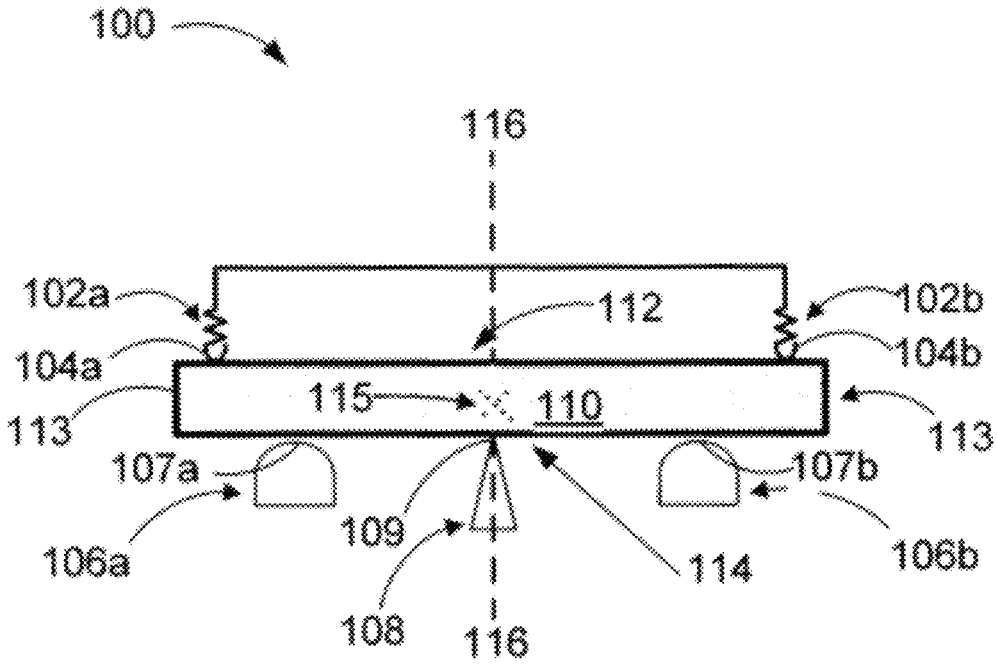
FIG. 1 is a schematic of a PTC thermistor device in accordance with one embodiment of the invention.

Referring now to FIG. 1, an exemplary thermistor device 100 includes an electronic element 110 (also referred to as a pill 110) having first and second electrodes, 112 and 114, located on the opposite sides of the electronic element 110. The electronic element includes sidewall portions connecting the opposite sides, and the surface of the sidewall portions define an outer periphery 113 of the electronic element 110. Typically, the pill 110 is a positive temperature coefficient (PTC) ceramic disc-shaped member as is known in the art.

The PTC thermistor device 100 further includes a first elastic support 102*a* including a first contact section 104*a* in contact with the first electrode 112 and a second elastic support 102*b* including a second contact section 104*b* in contact with the first electrode 112 at a different position from the first contact section 104*a* on the opposite side of the center of the pill. The PTC thermistor device 100 further includes a third support 108 disposed closer to the center of the pill 110 than the first contact section 104*a* and the second contact section 104*b*. The third support 108 includes a third contact section 109 in contact with the second electrode 114 and a pair of offset posts 106*a* and 106*b* (collectively referred to as offset posts 106) disposed on the same side of the pill 110 as the third support 108. Offset posts 106 each have a tip end 107*a* and 107*b*, respectively, and each tip end 107*a* and 107*b* is closer to an axis 116, perpendicular to the pill 110 and passing through the centroid of the pill, than either of the first and second contact sections 104*a* and 104*b*. Preferably, the offset posts 106 are located on opposite sides of a plane including the axis 116 (i.e., on opposite sides of the contact section 109) and each of the first and second contact sections 104*a* and 104*b* are located across from and further from a centroid point 115 of the pill 110 than the corresponding offset posts 106*a* and 106*b*. The shape of end of the offset posts 106 includes, but is not limited to, rectangular sections, rounded sections and slanted sections.

In a preferred embodiment, the offset posts 106 are located closer to the outer periphery 113 of the pill 110 than the third support 108. In this configuration the offset posts 106 provide additional leverage to assist in fracturing the pill 110 upon failure.

In normal operation of thermistor device 100, the pill 110, is mechanically supported between two opposing, conductive terminals (not shown in FIG. 1). One terminal is attached to the first elastic support 102*a* and the second elastic support 102*b* (collectively referred to as elastic supports 102) and the other terminal is attached to the third support 108, which in one embodiment is a rigid support.

In a preferred embodiment, the offset posts 106 are not in contact with the pill 110 when it is functioning normally. In this embodiment, both offset posts 106 are spaced apart from the pill 110 and electrically isolated from the second electrode 114 and the third contact section 109. The offset posts are generally less than 2 millimeters from second electrode 114, and preferably between near zero and 0.5 millimeters. Due to the lack of intimate contact during normal operation, less expensive materials may be employed for the offset posts due to the fact that they are not exposed to as high of a temperature as they would be if in direct contact with second electrode 114. Additionally, such materials typically are easier to mold, as well as being less brittle.

Under normal operating conditions, the first and second elastic supports 102 and corresponding first and second contact sections 104*a* and 104*b* (collectively referred to as contact sections 104) apply a first and second force, respectively, on the electronic element which is opposed by a third force applied by the third support 108 and third contact section 109. The third force is generally greater than the first force and the second force. The force applied by the third support 108 approximately in the center of the pill 110 increases the probability of fracture along a plane going through the axis 116 of the pill 110 at the time of pill 110 failure.

Figure 2:
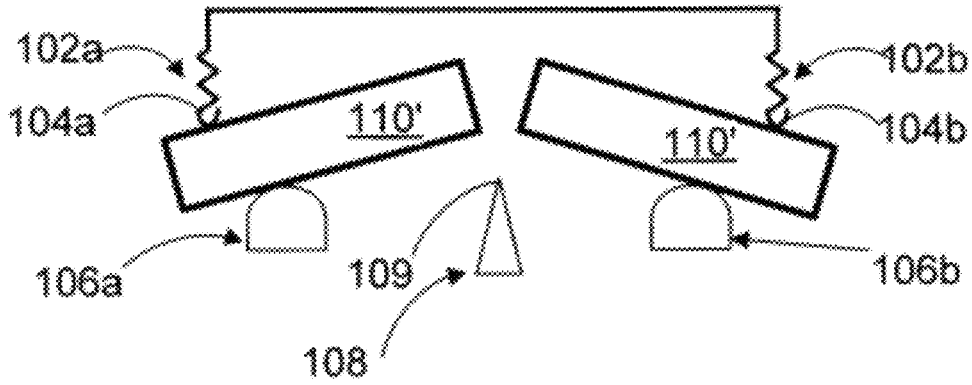
FIG. 2 is a schematic view of the PTC thermistor device shown in FIG. 1 after failure of the PTC thermistor.
Figure 3:
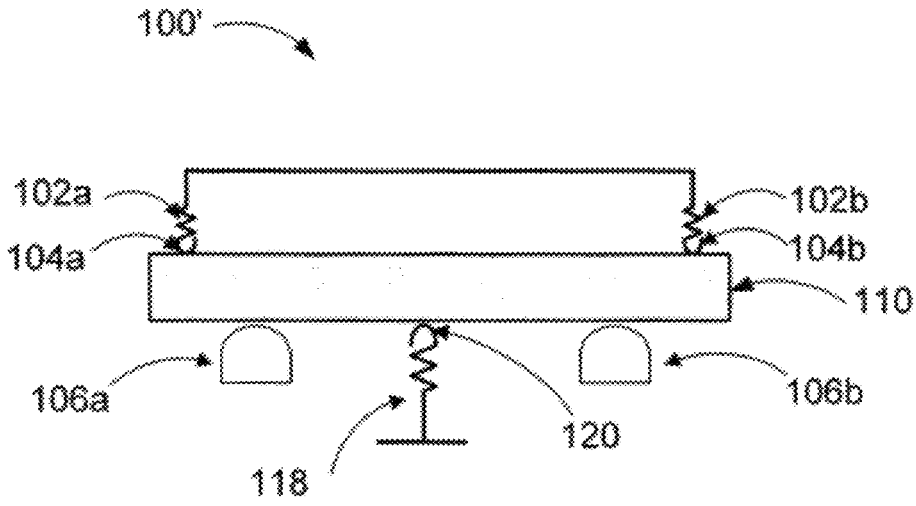
FIG. 3 is a schematic of a PTC thermistor device similar to the device shown in FIG. 1 in accordance with one embodiment of the invention.

Referring now to FIG. 2, upon pill 110 fracture, the first elastic support 102*a* including the first contact section 104*a* and the second elastic support 102*b* including the second contact section 104*b* drive the pill 110' fragments toward the offset posts 106*a* and 106*b*, resulting in fragment distribution and separation of the second electrode 114 from both the third contact section 109 and from the other pill 110' fragments. FIG. 3, illustrates a thermistor device 100' similar to the PTC thermistor device 100 of FIG. 1. Here, the third support 118 is a resilient contact with a contact section 120.

Figure 4:
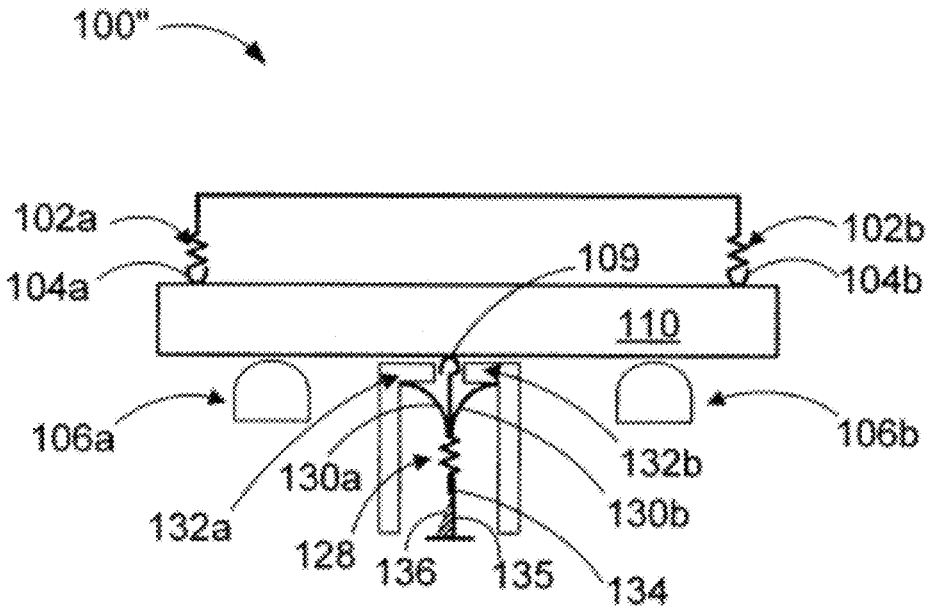
FIG. 4 is a schematic of a PTC thermistor device similar to the device shown in FIG. 1 in accordance with another embodiment of the invention.

Referring now to FIG. 4, another thermistor device 100" similar to the thermistor device 100' of FIG. 3, includes a third support 128 supported by a separate conductive member 135 to which it is connected by a fusible link 134, for example a solder joint. The thermistor device 100" includes alignment posts 132*a* and 132*b* which partially surround the third contact section 109. The thermistor device 100" further includes one or more withdrawal springs 130*a* and 130*b* which are coupled to the third support 128 and the alignment posts 132*a* and 132*b* (collectively referred to as alignment posts 132), respectively. In one embodiment, the alignment posts 132 form a cavity 138 between the alignment posts 132 and located over the third support partially surrounding the third contact section 109, to further insulate the third support 128 (also referred to as spring contact) upon pill 110 failure. An optional insulating member 136 (as shown in FIG. 4) may be placed near the fusible link 134 to ensure that the third support and supporting conductive member 135 are separated due to melting of the fusible link 134, further reducing the probability of electrical contact between the opposing terminals. The fusible link 134 is designed such that it will not melt at the maximum ambient temperatures and currents produced by sustained running of a refrigerator compressor, as long as the pill 110 is functioning as designed for said refrigerator compressor.

Figure 5:
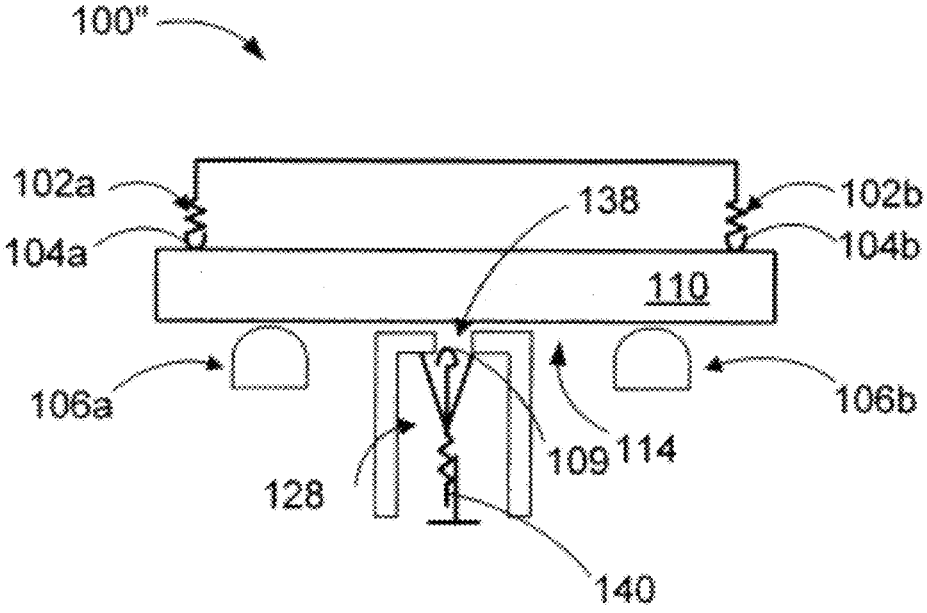
FIG. 5 is a schematic view of the PTC thermistor device shown in FIG. 4 after failure of the PTC thermistor.

As shown in FIG. 5, upon pill 110 failure excessive heat generated by thermal runaway in the pill 110 or its fragments conduct heat and/or excessive current through the single spring contact (135, 128 and 109), thereby melting the fusible link 134 and removing support from the single spring contact 128. The withdrawal springs 130*a* and 130*b* subsequently force the single spring contact 128 and contact section 109 away from the second electrode 114. The spring contact 128 is withdrawn into the cavity 138, reducing the probability of electrical contact between the opposing terminals. The optional insulating member 136 divides the spring contact and supporting conductive member when the two parts separate due to melting of the fusible link 134, further reducing the probability of electrical contact between the opposing terminals.

Figure 6:
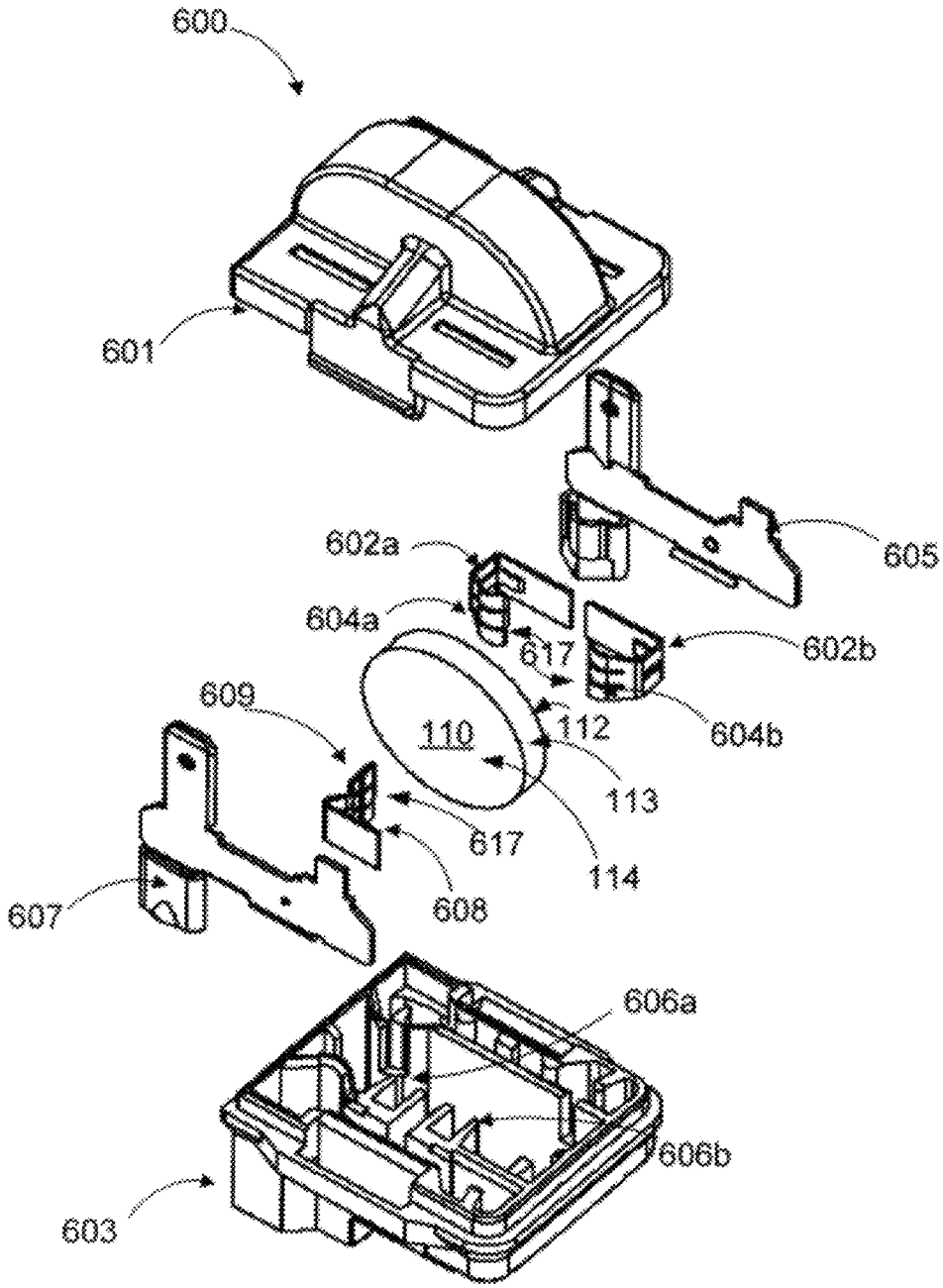
FIG. 6 is a perspective view of a PTC thermistor device in accordance with an alternative embodiment of the invention showing casing covers as separated from the remaining parts thereof to visually reveal the inside structure of the device.

FIG. 6, illustrates in more detail, another thermistor device 600 which includes a pill 110 similar to the pill 110 of FIG. 1. Device 600 includes an upper housing 601 and a lower housing 603 which partially encloses a first terminal connector 605 electrically coupled to a first elastic support 602*a* including a first contact section 604*a* in contact with the first electrode 112 and a second elastic support 604*b* including a second contact section 604*b* in contact with the first electrode 112 at a different position from the first contact section 604*a*. Device 600 further includes a second terminal connector 607 disposed on a different side of the pill 110 than the first terminal 605 and electrically coupled to a third support 608 having a third contact section 609 in contact with the second electrode 114 and disposed closer to the center of the pill 110 than the first contact section 604*a* and the second contact section 604*b*.

In one embodiment, the first contact section 604*a*, second contact section 604*b* and third contact section 609 can each include multiple split fingers 617, for example, three fingers as shown in FIG. 6. A pair of offset posts 606*a* and 606*b* (collectively referred to as offset posts 606), attached to the lower housing 603 are, in one embodiment, spaced apart from the pill 110 and electrically isolated from the pill 110 and the first contact section 604*a*, the second contact section 604*b* and the third contact section 609.

The offset posts 606 are located on the side of the second electrode 114, each having a tip end (shown in more detail in FIG. 8), the offset posts being located closer to the outer periphery 113 of the electronic element than the third support 608 and on each side of the third support 608. The offset posts 606 are disposed to distribute fractured portions of a fractured pill 110' such that electrical contact to the fractured pill 110' is removed and electrical arcing among fractured portions and contact sections 604 and 609 is minimized.

Figure 7:
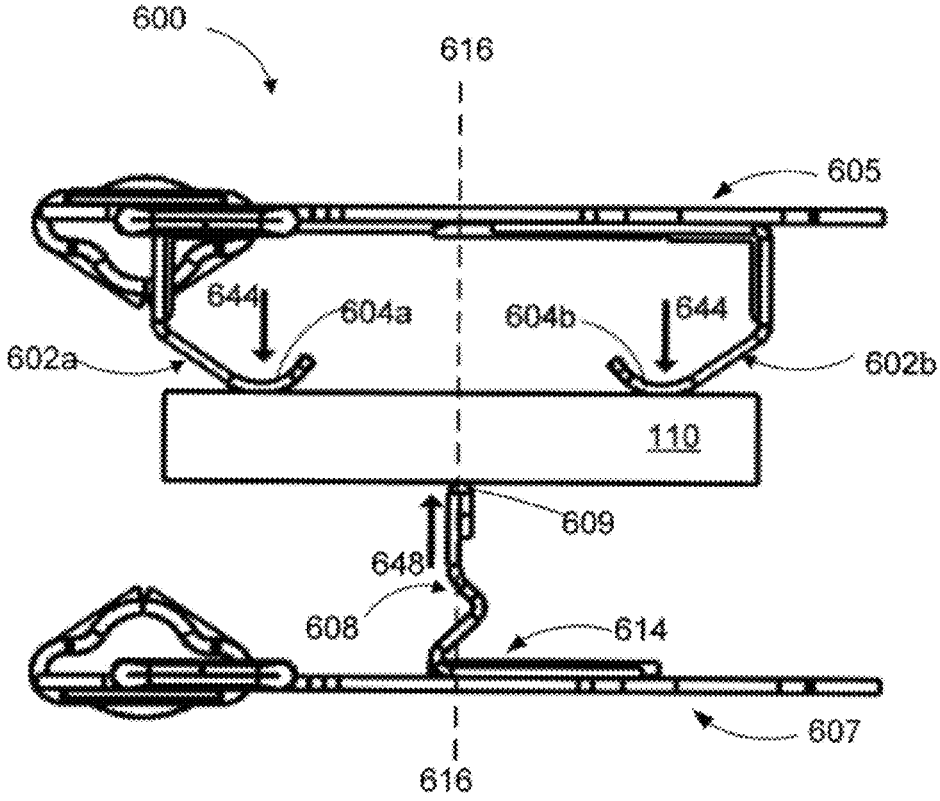
FIG. 7 is a top cross sectional view of the PTC thermistor device of FIG. 6.

FIG. 7, in a top cross-sectional view of the device 600, illustrates placement of components with respect to an axis 616 aligned along a major axis of the third support and approximately perpendicular to the pill 110. In one embodiment, the first and second elastic supports 602 are cantilever springs. The first and second elastic supports 602 and corresponding first and second contact sections 604 apply a first and second force (indicated by arrows 644), respectively, on the pill 110 which is opposed by a third force applied by the third support 608 and third contact section 609. The third force is typically greater than the first force and the third force is greater than the second force. Such a configuration promotes distribution of the fractured pill 110' fragments upon failure.

After assembly, the third support is mounted to and electrically connected to the second terminal connector 607 which is substantially parallel to the pill 100 and the third force is directed along the axis substantially perpendicular to the pill 110. The first and second forces have a force component directed substantially perpendicular to the pill 110 and in the embodiment using cantilever or similar springs, a force component is also directed towards the outer periphery of the electronic element. In one embodiment, the elastic supports 602 are welded to the first terminal connector 605 and the third support 608 is welded to the second terminal connector 607. In an alternate embodiment the first elastic support 602*a*, the second elastic support 602*b* and first terminal connector 605 can each be an integrated into a one-piece terminal component. Also, the third support 608 and second terminal connector 607 can be an integrated into a one-piece terminal component.

Figure 8:
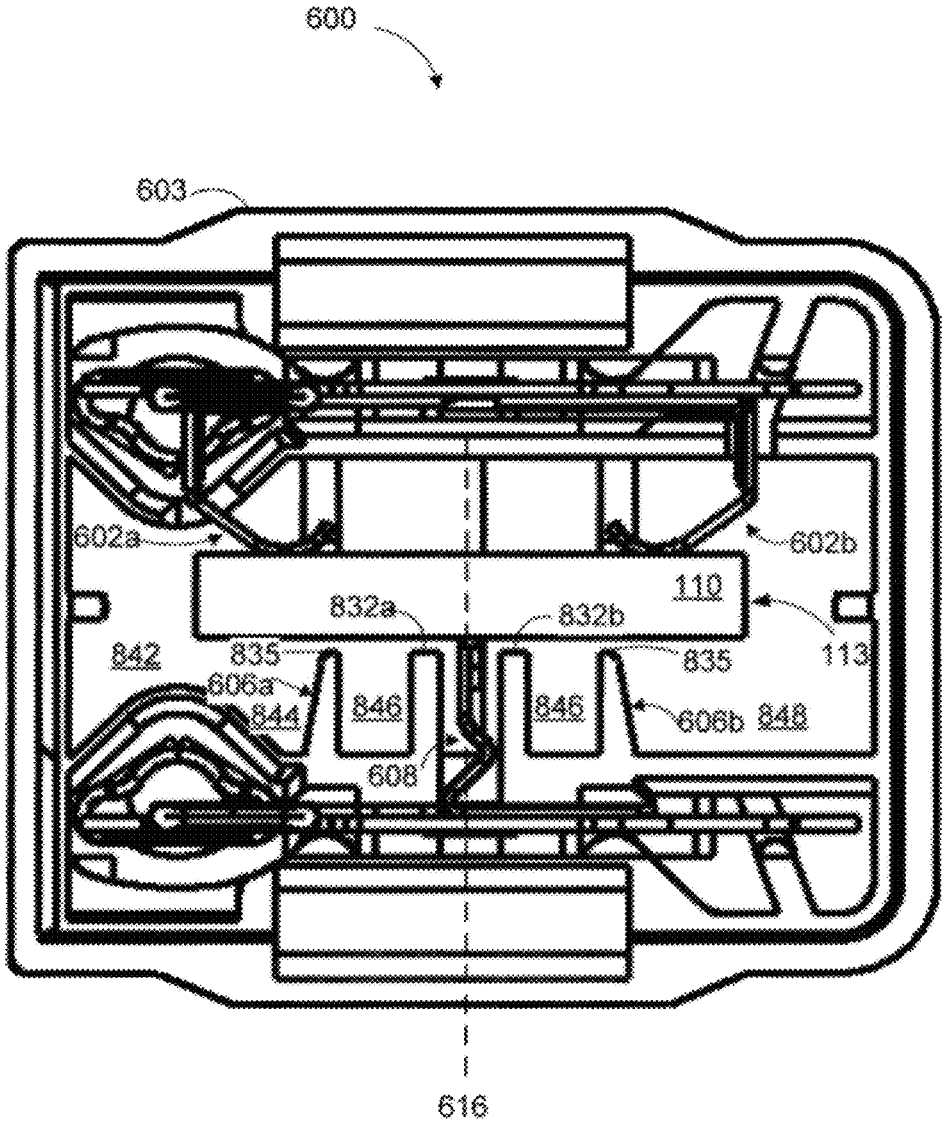
FIG. 8 is a top cross sectional view illustrating several parts assembled in a lower housing of the PTC thermistor device of FIG. 6.

In more specific detail, as seen in FIG. 8, the device 600 further includes a pair of offset posts 606 spaced apart from the electronic element and electrically isolated from the electronic element 110 and the first, second and third contact sections 602*a*, 602*b* and 608, respectively. The offset posts 606 are located on the side of the second electrode 114, each having a slanted cut-away section on a tip end 835. In one embodiment, the offset posts are located closer to the outer periphery 113 of the pill 110 than the third support 608, the slanted portion is angled away from the center of the pill 110; and the slanted tip ends are closer to the axis 116, than the pill contact portions of the first and second contact sections 602*a* and 602*b*. Both offset posts preferably are spaced apart from the pill 110 and electrically isolated from the second electrode 114 and the third contact section 608. The location and shape of these features promote distribution of pill fragments into compartments 842, 844, 846 and 848, upon failure of the pill 110.

A pair of contact alignment posts 832*a* and 832*b* are located adjacent to the third support 608 and on opposite sides of the axis 116. In one embodiment, the offset posts 606 and corresponding contact alignment posts 832*a* and 832*b* form compartments 846 therebetween to collect and insulate fractured electronic element rubble from the contact sections 609 and 604. The pair of contact alignment posts 832*a* and 832*b* (collectively referred to as alignment posts 832), facilitate, in manufacturing and operation, the alignment, protection and orientation of the third support 608 and the third contact section 609. In one embodiment, the third support 608 is an elastic support and in an alternative embodiment, the third support 608 and the third contact section 609 are integrated as a rigid support, for example a single conductive component terminated at one end with a contact section which does not damage the pill 110 under normal operating conditions but aids in fracturing the pill 110 upon failure. In another embodiment, the third support 608 and the third contact section 609 are implemented as a conductive pedestal. In yet another embodiment, an integrated motor protector (not shown) is included in the housing electrically connected to thermistor device 100.

Before the pill 110 is fractured, it is supported by the elastic contacts 602 forcing the pill 110 against third support 608, which as described above can be a rigid support on an elastic support. Upon pill 110 failure, the fractured pill 110' is forced to contact the pair of offset posts 606 and as a result fracture portions of the fractured pill 110' are distributed away from the first, second and third contacts. Under some failure modes the fractured portions are rotated around the outer edges (e.g., the slanted tips) of the pair of offset posts and distributed into compartments 842, 844 and 848.

Although the invention has been described with regards to specific preferred embodiments thereof, variations and modifications will become apparent to those of ordinary skill in the art. It is therefore, the intent that the appended claims be interpreted as broadly as possible in view of the prior art to include such variations and modifications.

What is claimed is:

1. An electronic device comprising:

an electronic element having opposite sides with first and second electrodes located on the opposite sides of the electronic element, the electronic element having sidewall portions connecting the opposite sides, the surface of the sidewall portions defining an outer periphery of the electronic element;

a first elastic support including a first contact section in contact with the first electrode;

a second elastic support including a second contact section in contact with the first electrode at a different position from the first contact section;

a third support disposed closer to the center of the electronic element than the first contact section and the second contact section, and including a third contact section in contact with the second electrode;

a pair of offset posts disposed on the same side of the electronic element as the third support and each having an end with a tip, and wherein the each tip end is closer to an axis, through the centroid of the electronic element and approximately perpendicular to the electronic element, than the first and second contact sections.

2. The device of claim 1, wherein the third support is a resilient support.

3. The device of claim 1, wherein both offset posts are spaced apart from the electronic element, electrically isolated from the second electrode and the third contact section and disposed.

4. The device of claim 3, wherein both offset posts are spaced apart from the electronic element between near 0 and 2 millimeters.

5. The device of claim 1, wherein each tip end includes one of:

a slanted cut-away section; and a rounded section.

6. The device of claim 1, further comprising a pair of contact alignment posts adjacent to the third support and on opposite sides of the axis.

7. The device of claim 6, wherein the offset posts and corresponding contact alignment posts form a compartment therebetween to collect and insulate fractured electronic element rubble from the first, second and third contact sections.

8. The device of claim 1, wherein the offset posts are located on opposite sides of a plane including the axis and each of the first and second contact sections are located closer to the periphery of the electronic element from a corresponding offset post.

9. The device of claim 1, wherein, the offset posts are located closer to the outer periphery of the electronic element than the third support.

10. The device of claim 9, wherein the first and second elastic supports each comprise a cantilever spring.

11. The device of claim 1, wherein the first and second elastic supports and corresponding first and second contact sections apply a first and second force, respectively, on the electronic element which is opposed by a third force applied by the third support and third contact section; and wherein the third force is greater than the first force and the third force is greater than the second force.

12. The device of claim 11 further comprising:

a terminal connector, disposed substantially parallel to the electronic element, and to which the third support is mounted; and wherein the third force is directed along the axis substantially perpendicular to the electronic element.

13. The device of claim 11, wherein each of the first and second forces has a force component directed substantially perpendicular to the electronic element and a force component directed towards the outer periphery of the electronic element.

14. The device of claim 1, wherein the electronic element comprises a positive temperature coefficient (PTC) thermistor disk.

15. The device of claim 1 further comprising a housing which contains the device and an integrated motor protector.

16. The device of claim 1, wherein the third support comprises a fusible link which upon melting will remove the third contact section from electrical contact with the second electrode.

17. An electronic device comprising:

an electronic element having opposite sides and having first and second electrodes which are located on the opposite sides of the electronic element, the electronic element having sidewall portions connecting the opposite sides, the surface of the sidewall portions defining an outer periphery of the electronic element;

a first terminal connector electrically coupled to a first elastic support including a first contact section in contact with the first electrode and a second elastic support including a second contact section in contact with the first electrode at a different position from the first contact section;

a second terminal connector disposed on a different side of the electronic element than the first terminal and electrically coupled to a third support and including a third contact section, in contact with the second electrode, disposed closer to the center of the electronic element than the first contact section and the second contact section.

a pair of offset posts spaced apart from the electronic element and electrically isolated from the electronic element and the first, second and third contact sections, the offset posts located on the side of the second electrode, each having a tip end, the offset posts being located closer to the outer periphery of the electronic element than the third support and closer to the center of the electronic element than the first contact section and the second contact section;

a pair of contact alignment posts disposed adjacent to and partially enclosing the third support;

wherein the electronic element comprises a positive temperature coefficient (PTC) thermistor disk; and wherein the offset posts are disposed to distribute fractured portions of a fractured electronic element such that electrical contact to the electronic element is removed and electrical arcing among fractured portions and contact sections is minimized.

18. A method of directing fractured portions of a fractured electronic element such that electrical contact to the electronic element is removed and electrical arcing among fractured portions and contact sections is minimized comprising:

providing a housing and a pair of first and second spring contacts disposed in the housing on one side of the electronic element;

providing in the housing a pair of offset posts on an opposite side of the electronic element not in contact with the electronic element with a third contact disposed therebetween;

elastically supporting the electronic element before fracture by the pair of first and second spring contacts and the third contact; and upon fracture of the electronic element:

forcing contact of the electronic element with the pair of offset posts; and distributing the fractured portions away from the third contact.

19. The method of claim 18, wherein distributing the fractured portions comprises rotating the fracture portions around the outer edges of the pair of offset posts.

20. The method of claim 18, wherein the spring contacts are cantilever spring contacts.

* * * * *